United States Patent [19]

Sato

[11] 3,942,459

[45] Mar. 9, 1976

[54] METHOD OF CONSTRUCTING LOW TEMPERATURE LIQUEFIED GAS TANKER SHIPS

[75] Inventor: Toru Sato, Kamakura, Japan

[73] Assignee: Bridgestone Liquefied Gas Company, Ltd., Tokyo, Japan

[22] Filed: Aug. 16, 1972

[21] Appl. No.: 281,003

[30] Foreign Application Priority Data

Aug. 17, 1971 Japan ..... 46-62020

[52] U.S. Cl. ..... 114/74 R

[51] Int. Cl.[2] ..... B63B 3/02

[58] Field of Search ..... 114/72, 74, 65, 77, 43.5, 114/44–49, 235 R

[56] References Cited

UNITED STATES PATENTS

| | | | |
|---|---|---|---|
| 2,406,084 | 8/1946 | Levin | 114/43.5 |
| 3,325,037 | 6/1967 | Kohn et al. | 114/74 A |
| 3,349,742 | 10/1967 | Bylo | 114/77 R |
| 3,417,721 | 12/1968 | Vienna | 114/43.5 |

FOREIGN PATENTS OR APPLICATIONS

| | | | |
|---|---|---|---|
| 1,330,876 | 12/1963 | France | 114/77 R |

*Primary Examiner*—Duane A. Reger
*Assistant Examiner*—Sherman D. Basinger
*Attorney, Agent, or Firm*—Stewart and Kolasch, Ltd.

[57] ABSTRACT

A method of constructing low temperature liquefied gas tanker ships equipped with containers made of low temperature resisting material, the containers each being positioned in a hold space defined by the inner wall of a hull and a bulkhead with interposition of a heat insulating layer, characterized by forming tank assemblies each being composed of the container, said heat insulating layer covering the outer surface of the container and a water-tight layer provided over the heat insulating layer, floating the tank assemblies on the surface of the water at the positions just above the hold spaces of the hull which is kept sunk in the water, and making at least either the tank assemblies or the hull come closer to each other so that the tank assemblies are inserted into the corresponding hold spaces of the hull, whereby the construction of the tanks can be proceeded separately from and in parallel with the hull construction to spare time and the tank assemblies are mounted into the hold spaces of the hull with no requirement of heavy cranes having high lift and long reach of suspension.

2 Claims, 8 Drawing Figures

METHOD OF CONSTRUCTING LOW TEMPERATURE LIQUEFIED GAS TANKER SHIPS

BACKGROUND OF THE INVENTION

1. Field of the Invention

This invention relates to a method of constructing tanker ships for transporting low temperature liquefied gases such as petroleum gases which are in a gaseous state at room temperature and can be liquefied under atmospheric pressure. More particularly, this invention relates to a method of constructing low temperature liquefied gas tanker ships equipped with containers made of low temperature resisting material, said containers each being positioned in a hold space defined by the inner wall of a hull and a bulkhead with interposition of a heat insulating layer.

2. Description of the Prior Art

As a conventional method of constructing the low temperature liquefied gas tanker ships of the abovementioned structure, it has been proposed for the purpose of shortening the period of occupying a dock to construct tank assemblies each being made of said container and said heat insulating layer, the latter being provided over the outer surface of the former, separately from and in parallel with the hull of the tanker ship which is formed with the hold spaces for receiving said tank assemblies, and thereafter, to mount the tank assemblies into the hold spaces by suspending the tank assemblies by a crane or cranes and lowering them into the hold spaces of the hull. However, this method of construction involves a problem that it requires a heavy crane by which very large suspension height as well as reach are available.

SUMMARY OF THE INVENTION

Therefore, it is the main object of this invention to solve the abovementioned problem in the conventional method of constructing low temperature liquefied gas tanker ships wherein the tank assemblies and the hull are separately constructed and thereafter assembled together, and to provide a novel method which requires no heavy crane for mounting the tank assemblies into the hold spaces of the hull.

Another object of this invention is to provide a method of constructing low temperature liquefied gas tanker ships whereby the mounting of the tank assemblies into the hold spaces of the hull can be performed in the sea outside a dock.

Still another object is to provide a method of constructing low temperature liquefied gas tanker ships whereby all tank assemblies can be simultaneously mounted into the corresponding hold spaces of the hull.

These objects are accomplished, according to this invention, by forming said tank assemblies each being composed of said container, said heat insulating layer covering the outer surface of said container and a water-tight layer provided over said heat insulating layer, floating said tank assemblies on the surface of the water at the positions just above the hold spaces of the hull which is kept sunk in the water, and making at least either the tank assemblies or the hull come closer to each other so that the tank assemblies are inserted into the corresponding hold spaces of the hull.

BRIEF DESCRIPTION OF THE DRAWING

In the accompanying drawing.

DESCRIPTION OF THE PREFERRED EMBODIMENTS

This invention will now be described more particularly of some preferred embodiments with reference to the accompanying drawing.

Figure 1:
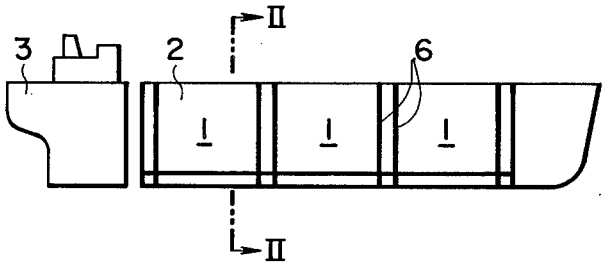
FIG. 1 is a longitudinal section of a tanker ship schematically showing the hull structure thereof in the way of construction.

FIG. 1 shows a tanker ship under construction, which presents hold spaces 1 defined in a main hull portion 2. In this embodiment, the main hull portion is constructed separately from a stern hull portion 3 adapted to be equipped with main engines, etc.

Figure 2:
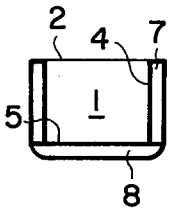
FIG. 2 shows a section along line II—II in FIG. 1.

As shown in FIG. 2, which is a cross section of the main hull portion 2, the hull is formed as a dual-walled hull having inner walls 4, inner bottom wall 5 and bulkheads 6 (FIG. 1) defining the hold spaces 1 and float chambers 7 and 8 provided between the dual walls.

Figure 3:
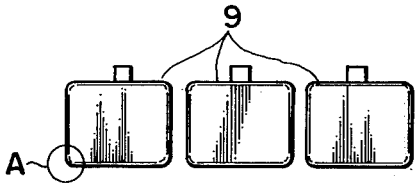
FIG. 3 is a side view of the tank assemblies to be mounted in the hull.
Figure 4:
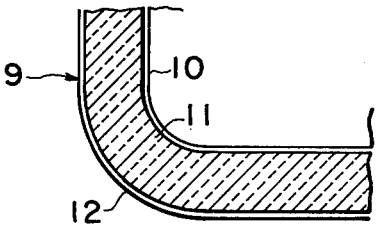
FIG. 4 is a sectional view of part A in FIG. 3.

FIG. 3 shows tank assemblies 9 adapted to be inserted into the hold spaces 1 and mounted therein. The tank assembly 9 has a wall structure as shown in FIG. 4 composed of a container 10 made of a low temperature resisting material, a heat insulating layer 11 covering the outer surface of the container 10 and a water-tight layer 12 such as a thin iron plate provided over the heat insulating layer. At least the bottom portion of the heat insulating layer 11 is formed as a compression resisting structure. These tank assemblies are constructed separately from the hull and in parallel construction with the hull.

Figure 6:
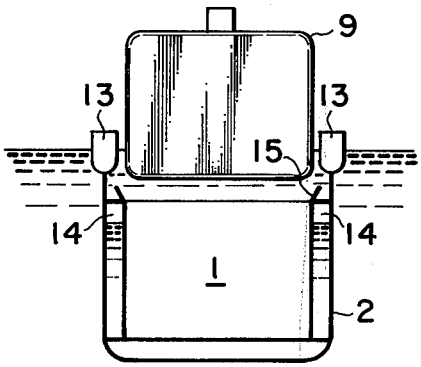
FIG. 6 shows a section along line VI—VI in FIG. 5.
Figure 5:
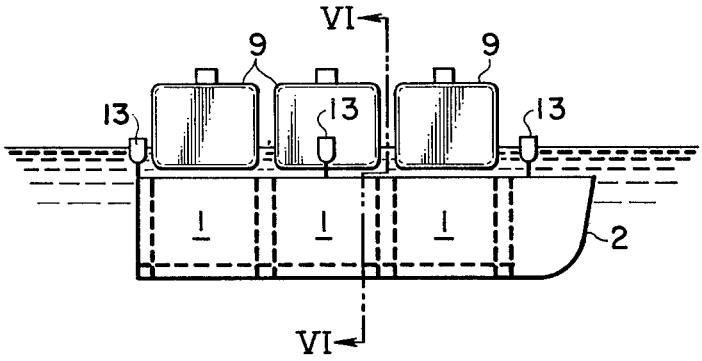
FIG. 5 shows an example of the manner of mounting the tank assemblies into the hull.

FIGS. 5 and 6 show an example of the manner of mounting the tank assemblies 9 into the hold spaces 1 of the hull. The main hull portion 2 is sunk in the water by the float chambers 7 and 8 being substantially filled with ballast water and is suspended in the water by buoys 13. The tank assemblies 9 are floated on the surface of the water and positioned just above the hold spaces 1 into which they are going to be inserted. The tank assemblies are kept at the determined positions by proper positioning means (not shown). Reference numeral 14 in FIG. 6 designates an air space left at the upper portion of the float chamber.

Starting from the state shown in FIGS. 5 and 6, the ballast water in the float chambers 7 and 8 is gradually pumped out to surface the main hull portion 2, whereby the tank assemblies 9 are gradually inserted into the corresponding hold spaces 1 of the hull.

In order to make it easier to insert the tank assemblies into the hold spaces, there are provisionally provided guide plates 15 at the upper end of the hold spaces 1. It is also preferable that the outer walls of the tank assemblies are formed with grooves (not shown) extending vertically and adapted to allow draining of the water contained in the hold spaces 1 as the tank assemblies are inserted therein. The water contained in the hold spaces may otherwise be drained by being pumped out by ballast pumps through drain pipes opening to the hold spaces at the inner bottom wall of the dual-walled hull.

Figure 7:
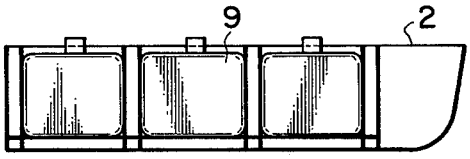
FIG. 7 is a longitudinal section of the hull mounted with the tank assemblies.

When the tank assemblies 9 have been completely inserted in the hold spaces of the main hull portion 2 as shown in FIG. 7, they are fixed at the positions by proper key means (not shown) to be attached on the wall surfaces defining the hold spaces. Thereafter, a deck 16 is constructed above the tank assemblies (FIG. 8).

Figure 8:
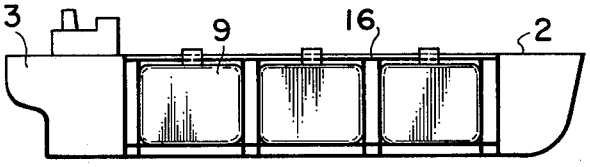
FIG. 8 is a longitudinal section of the hull finally attached with a stern hull portion.

After the main hull portion 2 has been completed with the tank assemblies mounted therein, it is combined with the stern hull portion 3, which has also been completed in the construction process performed in parallel with the main hull portion, to present a complete tanker ship as shown in FIG. 8.

In the abovementioned embodiment of this invention, the main hull portion 2 is sunk in the water by the float chambers 7 and 8 being filled with water, but as a modification, it is proposed that the main hull portion constructed in a dock is firmly fastened to the bottom of the dock by proper fastening means, while the dock is flooded with water so that the main hull portion is sunk in the water against the buoyancy due to the float chambers. Then, the tank assemblies floated on the water are properly positioned above the hold spaces of the main hull portion, and thereafter, the fastening means are gradually loosened to allow the main hull portion rise to the surface due to the buoyancy of the float chambers while the tank assemblies are accordingly inserted into the hold spaces of the main hull portion. This method is advantageous in the view point that it requires no pump for draining the float chambers 7 and 8.

As a further modification of the method of this invention, it is also proposed that the main hull portion is provided with valves at bottom portions thereof for selectively opening the bottom portions of the hull so that the inside space of the hull is also filled with water as the dock is filled with water when the valves are opened, whereby the main hull portion is automatically kept sunk in the water by filling the dock with water. Then, after the tank assemblies have been properly positioned as floated above the hold spaces of the hull, the water in the hold spaces as well as in the dock is drained to gradually lower the tank assemblies in the hold spaces. In this case, since the main hull portion is stably positioned on the bottom of the dock due to its own gravity, there is required no fastening means for fastening the main hull portion to the bottom of the dock against the buoyancy of the hull.

Although it is proposed in the embodiments described in the above that the stern hull portion 3 is attached to the main hull portion 2 after the main hull portion has been mounted with the tank assemblies, the main hull portion 2 may of course be combined with the stern hull portion before it is mounted with the tank assemblies.

Furthermore, the main hull portion may be divided into several hull blocks which are separately mounted with the tank assemblies in the manner described above.

The container 10 of the tank assembly 9 may be of a membrane type which itself is already well known in the art. In this case the heat insulating layer 11 is required to be of a compression resisting type not only at the bottom portion thereof but also at the side wall portions thereof. In this case it is preferable that the clearance left between the inside surface defining the hold space and the tank assembly is filled with proper filling material such as polymer cement so that the membranous container is uniformly supported over the whole area thereof.

I claim:

1. A method of mounting at least one tank made of a low-temperature resisting material within the tank hull portion of a floatable vessel having an engine hull portion and said tank hull portion, said tank hull portion being provided with float chambers and said tank being positioned in a hold space defined by the inner walls of the tank hull portion, which comprises, at least partially flooding said tank hull portion, by introducing ballast water into a substantial portion thereof while maintaining a partial air space in said float chambers to suspend the tank hull portion in the water, stabilizing said flooded tank hull portion by suspending said tank hull portion from buoys, floating at least one tank into position over a desired final position with respect to the hold space of said tank hull portion, seating at least one of the tanks into its desired final position within the hold space by draining said float chambers, thereby causing the hull portion to float up to the surface of the water and connecting said tank hull portion with the engine hull portion.

2. The method of claim 1 wherein the tank hull portion is divided by bulkheads into a plurality of hold spaces and a plurality of tanks are mounted into said hold spaces.

* * * * *